US007610923B2

(12) United States Patent
Hedstrom et al.

(10) Patent No.: US 7,610,923 B2
(45) Date of Patent: Nov. 3, 2009

(54) PUMP AND FILTER SYSTEM FOR A DRAWER-TYPE DISHWASHER

(75) Inventors: Kristen K. Hedstrom, Orlando, FL (US); Mark E. Palm, Orlando, FL (US); Rodney M. Welch, Jackson, TN (US)

(73) Assignee: Maytag Corporation, Benton Harbor, MI (US)

( * ) Notice: Subject to any disclaimer, the term of this patent is extended or adjusted under 35 U.S.C. 154(b) by 633 days.

(21) Appl. No.: 11/052,862

(22) Filed: Feb. 9, 2005

(65) Prior Publication Data

US 2006/0174924 A1 Aug. 10, 2006

(51) Int. Cl.
*B08B 3/04* (2006.01)

(52) U.S. Cl. ..... 134/104.4

(58) Field of Classification Search ..... 134/104.4
See application file for complete search history.

(56) References Cited

U.S. PATENT DOCUMENTS 4,285,390 A * 8/1981 Fortune et al. ..... 165/210
4,392,891 A 7/1983 Meyers
4,559,959 A 12/1985 Meyers
4,848,382 A * 7/1989 Bertsch et al. ..... 134/111
5,097,855 A 3/1992 Martinsson et al.
5,165,433 A 11/1992 Meyers
5,333,631 A 8/1994 Kirkland et al.
5,345,957 A 9/1994 Cooper et al.
5,433,228 A 7/1995 Dingler
5,450,868 A * 9/1995 Young, Jr. ..... 134/111
5,601,660 A 2/1997 Jeon et al.
5,628,334 A 5/1997 Edwards et al.
5,700,329 A * 12/1997 Edwards et al. ..... 134/10
5,743,281 A * 4/1998 Sargeant et al. ..... 134/57 D
5,762,080 A 6/1998 Edwards et al.
5,848,601 A 12/1998 Thies
5,909,743 A 6/1999 Thies et al.
6,103,017 A 8/2000 Thies et al.
6,234,184 B1 5/2001 Tuller et al.
6,432,216 B1 8/2002 Thies
RE37,831 E 9/2002 Thies
6,460,555 B1 * 10/2002 Tuller et al. ..... 134/200

(Continued)

FOREIGN PATENT DOCUMENTS

EP 842632 5/1998

*Primary Examiner*—Michael Cleveland
*Assistant Examiner*—Samuel A Waldbaum
(74) *Attorney, Agent, or Firm*—John W. Morrison; Diederiks & Whitelaw PLC

(57) ABSTRACT

A drawer-type dishwasher includes a pump system which functions to pump and filter washing fluid in the dishwasher. The pump system includes a sump having an inlet passage, a recirculation passage, a drain passage, a coarse article collection chamber, a filter assembly that is divided into a filter chamber and a washing fluid manifold, and a stationary hub that rotatably supports a wash arm for spraying washing fluid onto dishware supported in the dishwasher. The filter chamber includes a fine particle collection chamber having a valve that selectively opens to allow particles trapped in the filter chamber and fine particle collection chamber to flow to the drain passage. The filter assembly includes a cover having a plurality of radial spaced openings over the filter chamber, as well as a central opening that receives a stationary hub member which rotatably supports a wash arm.

24 Claims, 7 Drawing Sheets

U.S. PATENT DOCUMENTS

| | | | | |
|---|---|---|---|---|
| 6,491,049 | B1 | 12/2002 | Tuller et al. | |
| 6,811,617 | B2 * | 11/2004 | Elick et al. | 134/10 |
| 2003/0029478 | A1 | 2/2003 | Hegeman | |
| 2003/0037809 | A1 | 2/2003 | Favaro | |
| 2003/0136931 | A1 * | 7/2003 | Watanabe et al. | 251/129.15 |
| 2004/0103927 | A1 * | 6/2004 | Ha | 134/57 R |
| 2004/0250837 | A1 * | 12/2004 | Watson et al. | 134/25.2 |
| 2006/0174916 | A1 * | 8/2006 | Hedstrom et al. | 134/25.2 |

* cited by examiner

PUMP AND FILTER SYSTEM FOR A DRAWER-TYPE DISHWASHER

BACKGROUND OF THE INVENTION

1. Field of the Invention

The present invention pertains to the art of dishwashers and, more particularly, to a pump and filtration system for a drawer-type dishwasher.

2. Discussion of the Prior Art

In general, drawer-type dishwashers are known in the art. Typically, a drawer-type dishwasher will include a drawer or washing tub slidably mounted in a cabinet. A dish rack is provided within the washing tub to support dishware and the like during a washing operation. In some cases, the dishwasher will include dual washing tubs arranged in an upper and lower configuration. However, regardless of the particular configuration, drawer-type dishwashers generally fall into two groups. In the first group, major wash system components, i.e., motors, pumps, heating elements and filters are fixedly mounted relative to the cabinet. The drawer is provided with structure that is adapted to engage into corresponding structure in the cabinet so as to both fluidly and electrically interconnect the drawer with the major wash system components. In the second group, the major wash system components are mounted directly to the drawer.

When designing a dishwasher that falls into the second group, space is of critical concern, even more so in models that include dual washing tubs. This is particularly true as it is generally desirable to position a dual drawer-type dishwasher under a kitchen counter in the space allotted for a more conventional dishwasher. Toward that end, manufactures have developed a variety of designs directed to minimizing an overall vertical height of the washing tub. In one configuration, a single motor is used to drive both a wash pump and a drain pump. In other configurations, a wash/drain pump is actually an integral part of another, separate wash system component, for example, a wash arm. In any event, in order to increase or otherwise maximize the vertical height of the washing tub, the overall number of major wash system components are typically reduced, along with the number of fluid conduits or passages that circulate the washing fluid throughout the washing tub. Regardless of the particular arrangement, the reduction in wash system components and fluid conduits, while achieving a desired decrease in required space, will limit the overall functionality of the dishwasher. That is, certain system components, such as heaters, filters, chopping blades and other advantageous elements typically found in larger units, cannot always be accommodated in more compact, drawer-type arrangements.

Based on the above, there exists a need in the art for a drawer-type dishwasher having all of the major wash system components typically found in larger, conventional dishwashers while maintaining a desired overall vertical height of a washing tub. More specifically, there exists a need for a drawer-type dishwasher including a pumping system that performs in a manner similar to that found in larger dishwashers, while at the same time conserving space so as to be more compact in nature.

SUMMARY OF THE INVENTION

The present invention is directed to a pump and filtration system for a drawer-type dishwasher including a drawer having front, rear, bottom and opposing side walls that collectively define a washing tub, and a plurality of wash system components for selectively performing a washing operation.

Preferably, the plurality of wash system components are mounted below the bottom wall of the washing tub. More preferably, a sump is formed in the bottom wall for collecting and managing washing fluid flow in the dishwasher. Toward that end, the sump includes an inlet passage, a recirculation passage and a drain passage. The sump also includes a coarse particle collection chamber that leads to the drain passage.

In accordance with a preferred embodiment of the present invention, a filter assembly is arranged above the sump. The filter assembly is actually divided into a filter chamber and a washing fluid manifold. The washing fluid manifold receives a flow of washing fluid from the wash pump and directs the flow of washing fluid upward into the washing tub. The washing fluid manifold also includes a sampling port that diverts a portion of the washing fluid into the filter chamber. Toward that end, the filter assembly is provided with a cover member including at least one large opening arranged above the filter chamber. The large opening is preferably provided with a fine mesh filtering screen for entrapping soil from the washing fluid in the filter chamber, while permitting cleansed washing fluid to be directed back into the washing tub. The entrapped soil is directed into a fine particle collection chamber that empties into the drain passage during select portions of the washing operation. Preferably, a solenoid actuated valve is opened to allow the soil particles to empty from both the filter chamber and the fine particle collection chamber.

In further accordance with the present invention, the cover member further includes a central opening arranged above the washing fluid manifold. A stationary hub member is arranged in the central opening of the cover member. The stationary hub includes a central passage, a sealing member and a central shaft that, when the stationary hub is positioned in the washing fluid manifold, causes the stationary hub to project above the cover member. The stationary hub is provided to rotatably support a wash arm configured to spray washing fluid onto dishware and the like in the washing tub. More specifically, washing fluid flowing into the washing fluid manifold is directed through the stationary hub member into the wash arm. At the same time, the washing fluid impinges upon the sealing member to form a barrier that prevents washing fluid from passing between the stationary hub and the cover member.

Additional objects, features and advantages of the present invention will become more readily apparent from the following detailed description of a preferred embodiment of the invention when taken in conjunction with the drawings wherein like reference numerals refer to corresponding parts in the several views.

DETAILED DESCRIPTION OF THE PREFERRED EMBODIMENT

Figure 1:
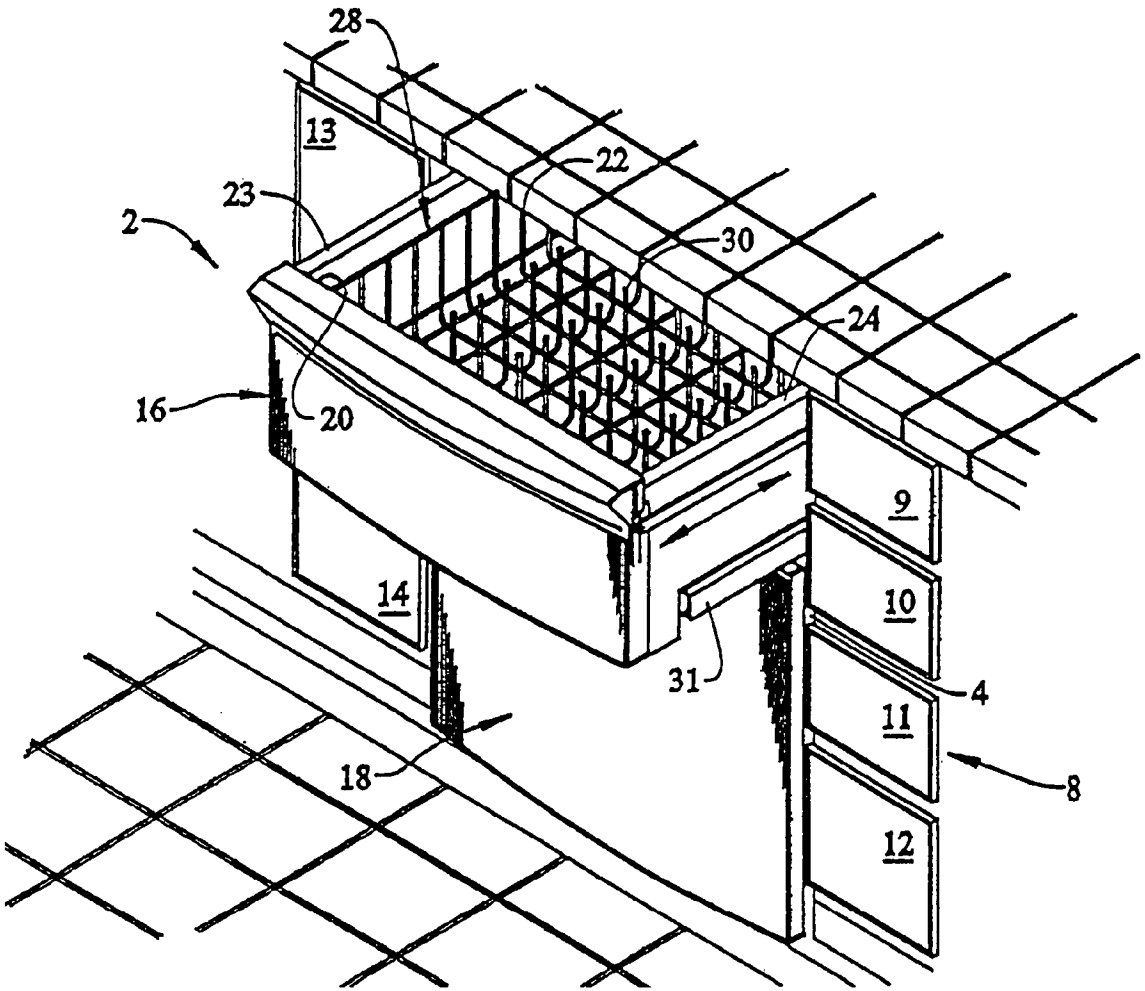
FIG. 1 is an upper right perspective view of a drawer-type dishwasher incorporating a pump and filter system constructed in accordance with the present invention.
Figure 2:
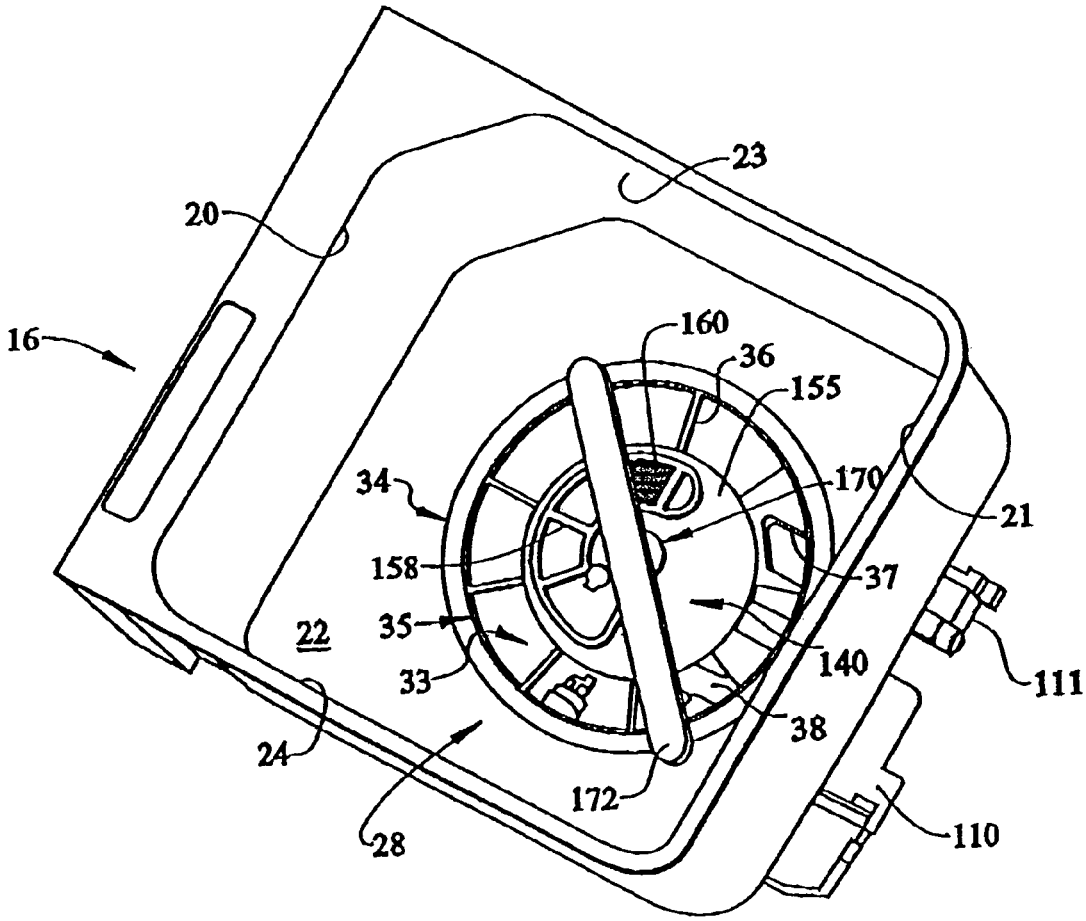
FIG. 2 is an upper perspective view of a washing tub of the dishwasher of FIG. 1.

With initial reference to FIGS. 1 and 2, a dishwasher constructed in accordance with the present invention is generally indicated at 2. As shown, dishwasher 2 includes a support frame 4 arranged below a kitchen countertop 6. Also below kitchen countertop 6 is shown cabinetry 8 including a plurality of drawers 9-12, as well as cabinet doors 13 and 14. Although the actual dishwasher into which the present invention may be incorporated can vary, the invention is shown in connection with dishwasher 2 depicted as a dual cavity dishwasher having an upper drawer 16 and a lower drawer 18. As best illustrated in FIG. 1, upper drawer 16 takes the form of a slide-out drawer unit having a small or medium capacity so as to be used for cleaning glassware and the like, while lower drawer 18 is illustrated as a larger capacity drawer for washing items such as dinnerware, cookware and other large sized objects.

Upper drawer 16 is shown to include a front wall 20, a rear wall 21, a bottom wall 22 and opposing side walls 23 and 24 that collectively define an upper washing tub 28. Upper washing tub 28 is provided with a dish rack 30 for supporting various objects, such as glassware, utensils and the like, to be exposed to a washing operation. Upper washing tub 16 is slidingly supported within support frame 4 through a pair of extendible drawer support guides, one of which is indicated at 31. In the embodiment shown, bottom wall 22 actually forms part of a sump 33 that, as will be discussed more fully below, manages a flow of washing fluid within drawer 16.

Figure 3:
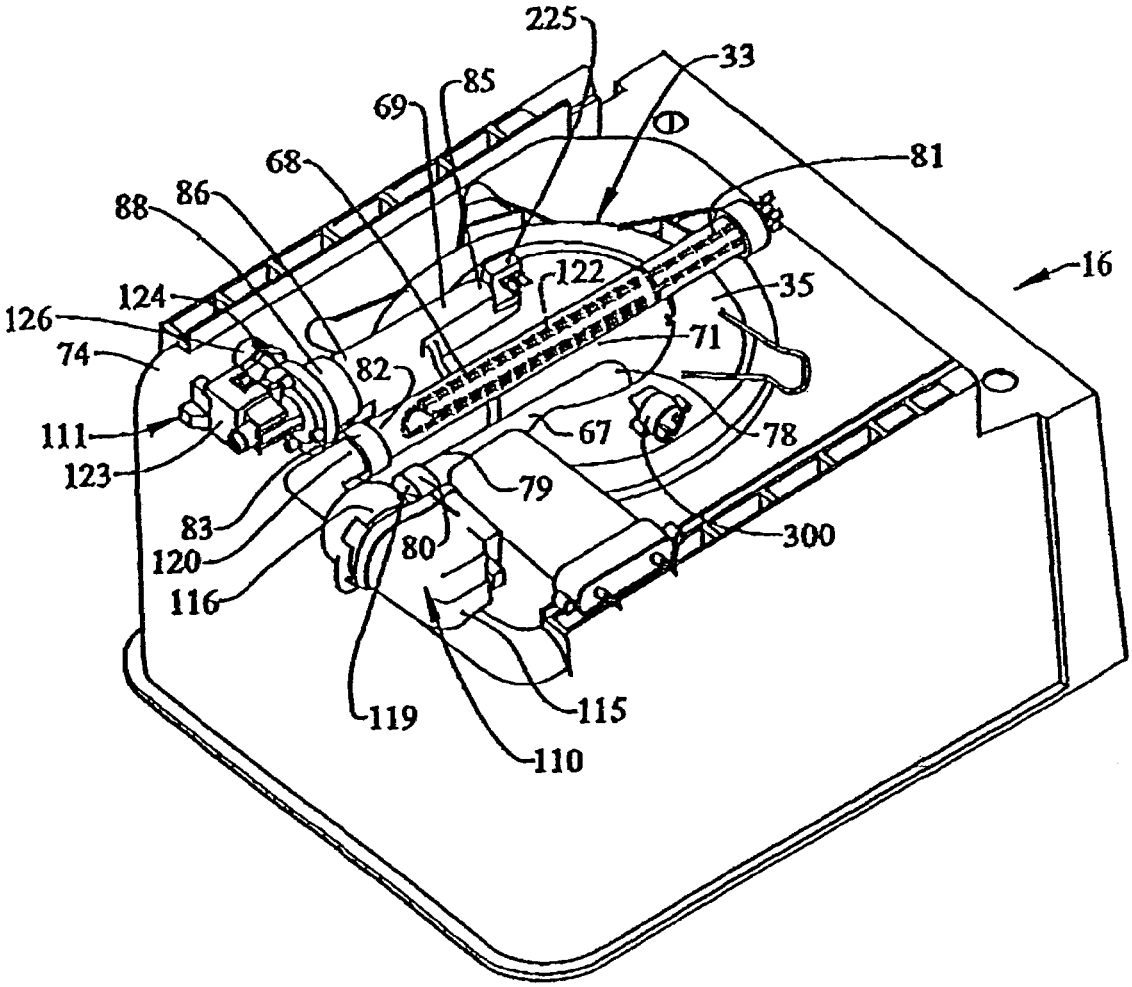
FIG. 3 is a lower perspective view of the washing tub of FIG. 2, illustrating portions of the pump system constructed in accordance with the present invention.
Figure 4:
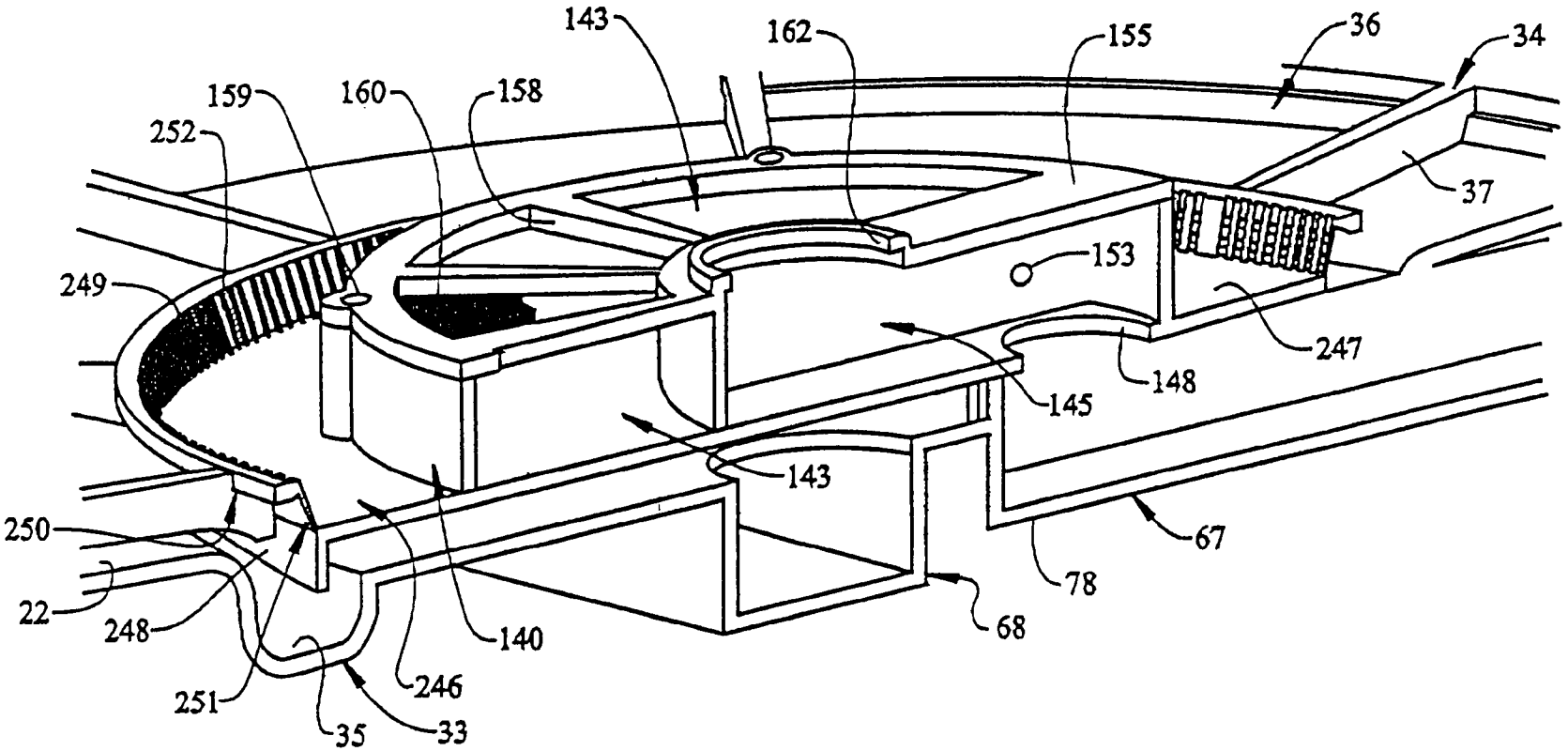
FIG. 4 is a partial, cross-sectional view taken along a bottom wall portion of the washing tub of the present invention.

As best shown in FIGS. 2-4, bottom wall 22 is provided with a recessed portion 34 having a generally U-shaped cross section defining an intake ring 35. A coarse particle strainer 36 extends about recessed portion 34 to trap/prevent large articles, such as utensils, bones and the like, from entering sump 33. Toward that end, coarse particle strainer 36 is includes a plurality of openings, one of which is indicated at 37, provided with a coarse filter screen (not shown) formed from, for example, a polyester mesh, plastic or stainless steel. Coarse particle strainer 36 traps larger objects that are collected in a coarse particle collection chamber 38, while allowing other particles to enter into sump 33.

Referring to FIG. 3, sump 33 includes a plurality of fluid conduits 67-69 formed along bottom wall 22 of washing tub 28. Alternatively, conduits 67-69 could be detachably secured to bottom wall 22. In the embodiment shown, fluid conduit 67 constitutes a wash fluid supply conduit, fluid conduit 68 constitutes a wash fluid recirculation conduit and fluid conduit 69 constitutes a wash fluid drain conduit. Each of fluid conduits 67-69 provides wash fluid flow management during a washing operation. Preferably, fluid conduits 67-69 are spaced from and arranged substantially parallel to one another on bottom wall 22, with conduits 67 and 69 extending from a central portion 71 of intake ring 35 to an outer edge portion 74 of washing tub 28. More specifically, supply conduit 67 includes a first end 78 which is in fluid communication with an interior portion of washing tub 28 and leads to a second end 79. Second end 79 is provided with an attachment flange 80. Likewise, recirculation conduit 68 extends from a first end 81, which extends beyond intake ring 35 toward a front portion of drawer 16, to a second end 82. In a manner corresponding to supply conduit 67, recirculation conduit 68 is provided with a corresponding attachment flange 83. Finally, drain conduit 69 extends from a first end 85 to a second end 86 which is also provided with an attachment flange 88.

Figure 6:
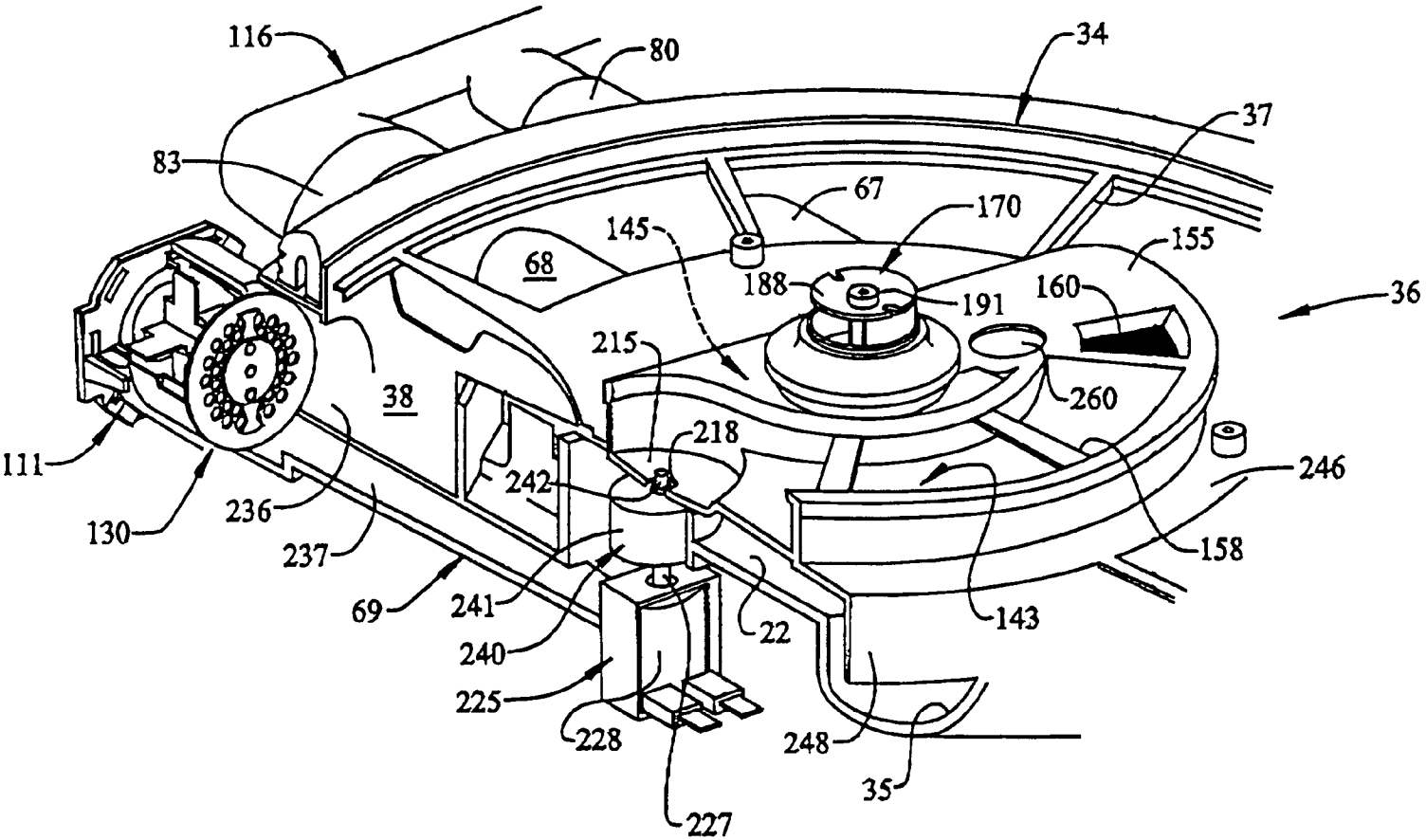
FIG. 6 is a partial, cross-sectional view of a bottom wall portion of the washing tub illustrating a valve sealing a fine particle collection chamber constructed in accordance with the present invention.
Figure 7:
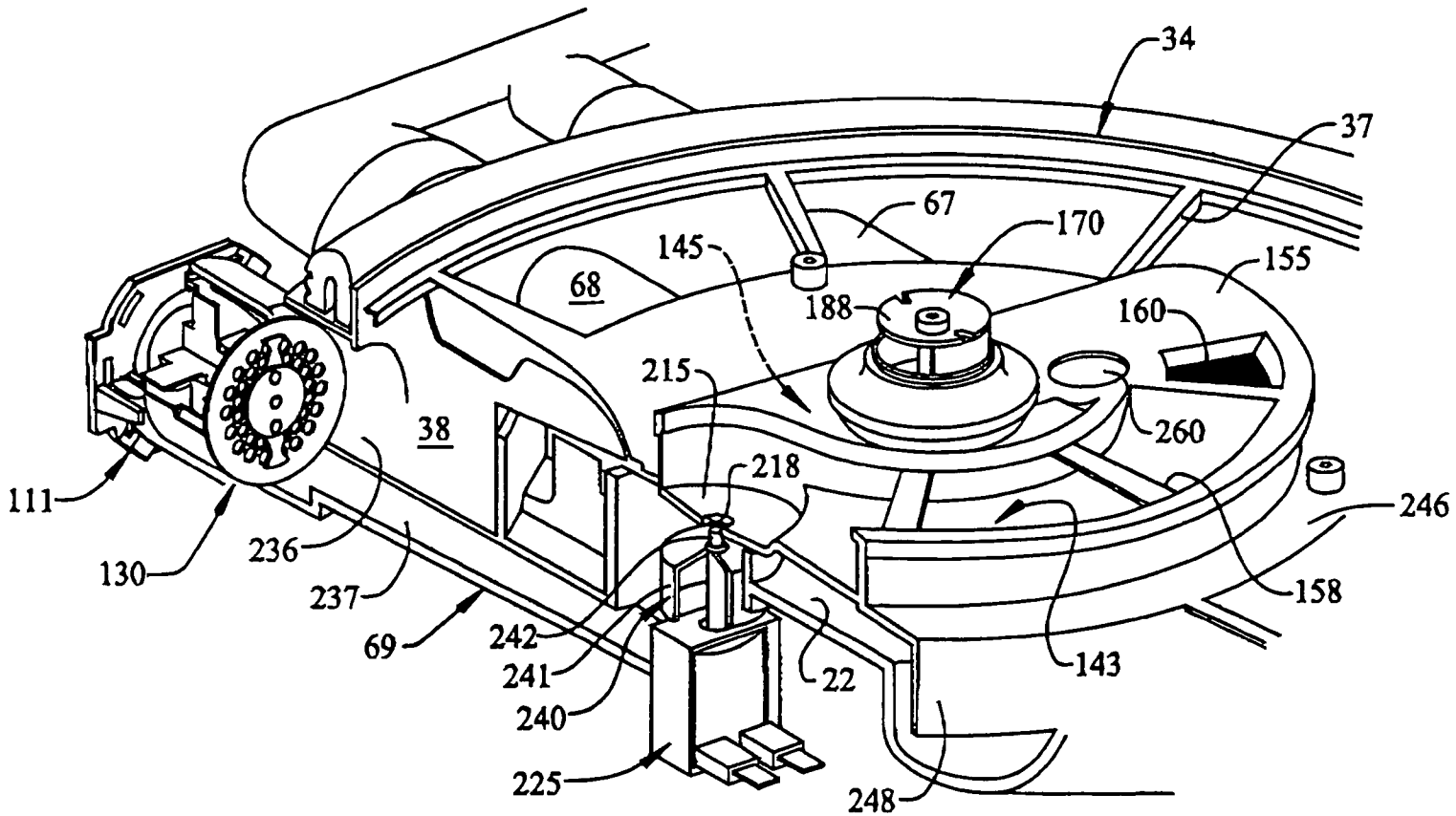
FIG. 7 is a partial, cross-sectional view of a bottom wall portion of the washing tub of FIG. 6 illustrating the valve in an open position wherein fine soil particles are guided to a drain pump.

In addition to managing the flow of washing fluid in dishwasher 2, sump 33 serves as a mounting platform for a plurality of wash system components. As best shown in FIG. 3, a wash pump 110 and a drain pump 111 are mounted to washing tub 28 along outer edge portion 74. Preferably, wash pump 110 includes a wash motor housing 115 and a wash pump housing 116. More preferably, wash pump housing 116 includes a supply outlet 119 and a recirculation inlet 120 that conducts wash fluid back from washing tub 28 to pump housing 116. Toward that end, wash pump housing 116 is generally F-shaped, with supply outlet 119 and recirculation outlet 120 projecting into attachment flanges 80 and 83 of supply and recirculation conduits 67 and 68 respectively. In the embodiment shown, a heater element 122 is positioned within recirculation conduit 68 to heat the washing fluid that is circulating into and out of washing tub 28. With this arrangement, a substantially closed loop recirculation system is formed within washing tub 28. Likewise, drain pump 111 includes a drain motor housing 123 and a drain pump housing 124. Drain pump housing 124 includes an inlet port (not shown) and an outlet port 126 adapted to be interconnected to a drain hose (not shown). The inlet port is preferably provided with a chopping mechanism 130, as best represented in FIGS. 6 and 7, for macerating food particles before being expelled with the washing fluid from washing tub 28 during periodic drain or purging operations.

Referring to FIGS. 2 and 4-7, dishwasher 2 includes a filter assembly 140 arranged centrally within coarse particle strainer 36. In accordance with the preferred form of the invention, filter assembly 140 is actually divided into a filter chamber 143 and a washing fluid manifold 145. Washing fluid manifold 145 is configured to receive a flow of washing fluid from wash pump 110 through an inlet 148 and thereafter direct or guide the washing fluid upward into washing tub 28. In further accordance with the invention, washing fluid manifold 145 is provided with a sampling port 153 that diverts a portion of the washing fluid flowing through inlet 148 into filter chamber 143.

Filter assembly 140 includes a cover member 155 having a plurality of large openings, one of which is indicated at 158. Preferably, cover member 155 is secured in place through a plurality of fasteners (not shown) that extend through a plurality of mounting bosses 159. In the embodiment shown, openings 158 are provided with a fine mesh filtering screen, which is partially shown at 160, for entrapping soil from the washing fluid in filter chamber 143, while permitting cleansed washing fluid to be directed back upward into washing tub 28. Therefore, openings 158 are provided solely over filter chamber 143 of filter assembly 140. In addition, cover member 155 is provided with a central opening 162 including an annular lip 163 (FIG. 5) that defines a recessed flange 164. As will be detailed more fully below, central opening 162 provides a passage for a stationary hub member 170 (FIGS. 6 and 7) that extends upward beyond cover member 155 into washing tub 28.

Figure 5:
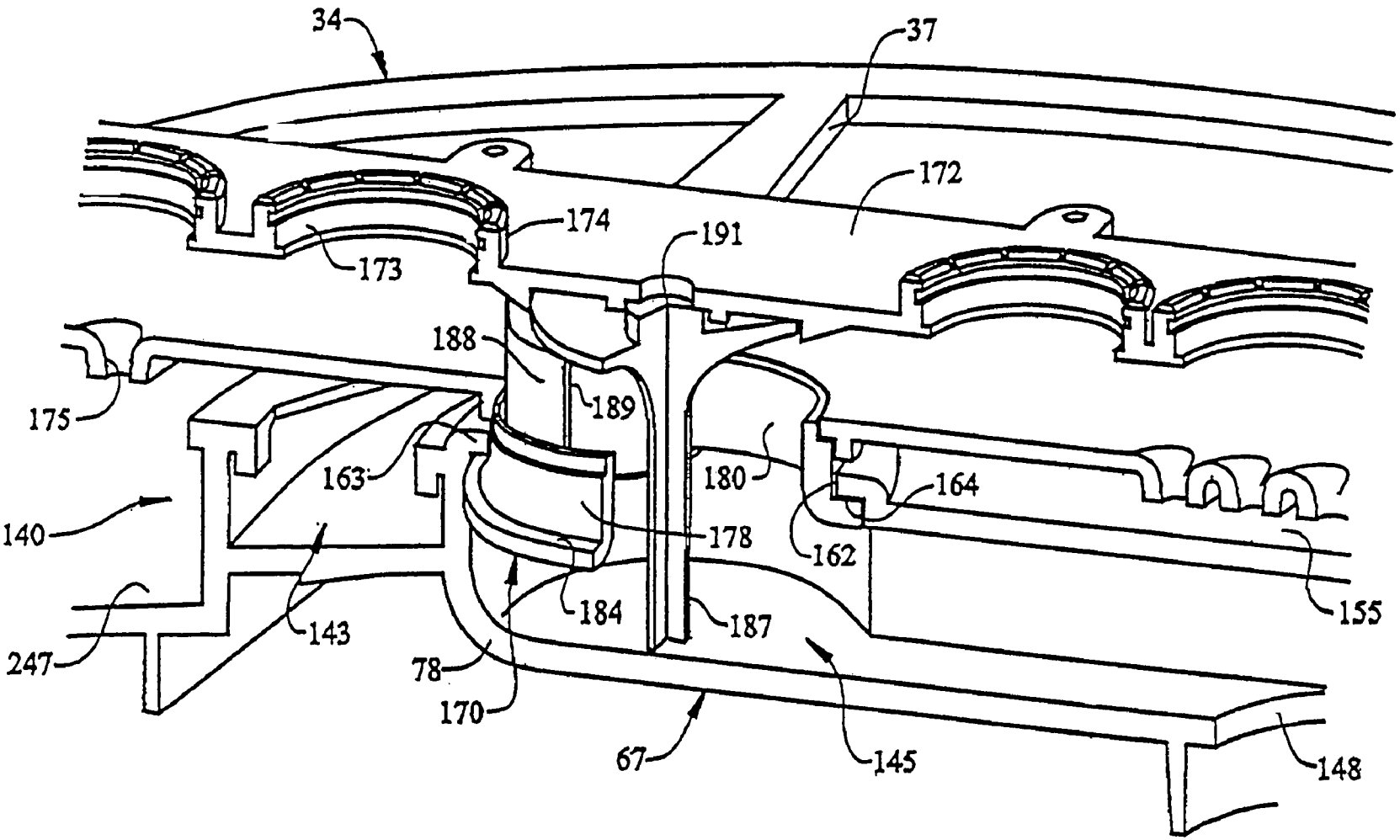
FIG. 5 is an enlarged view of a portion of FIG. 4.

As best shown in FIG. 5, stationary hub member 170 is adapted to rotatably support a wash arm 172 that directs jets of water onto kitchenware and the like arranged upon dish rack 30. In the embodiment shown, wash arm 172 includes a plurality of upwardly projecting openings 173, each of which includes a corresponding upstanding annular flange 174. Flange 174 is adapted to snap-fittingly receive an adjustable jet cap (not shown) that can be oriented, either at the factory or by a consumer, to obtain an optimal water spray in washing tub 28. In addition to upwardly projecting openings 173, wash arm 172 is provided with a plurality of downwardly projecting openings 175 that are directed onto mesh screen 160. In any event, stationary hub member 170 includes an outer surface 178 that defines a central passage or conduit 180 that guides washing fluid from washing fluid manifold 145 up into wash arm 172. In addition, extending about outer surface 178 is a sealing surface 184 that abuts cover member 155 to provide a seal about stationary hub 170. Actually, sealing surface 184 is forced against recessed flange 164 of central opening 159 in the presence of a flow of washing fluid to establish the seal. This particular configuration limits pressure losses to increase washing efficiency. Stationary hub member 170 includes a central shaft 187 that, when in position, abuts against a bottom portion (not separately labeled) of washing fluid manifold 145. Shaft 187 causes an upper portion 188 of stationary hub 170 to project above cover member 155. In this manner, stationary hub 170 is properly positioned to facilitate the assembly of wash arm 172. In the embodiment shown, upper portion 188 is provided with an outlet 189 that opens into wash arm 172. Arranged centrally on upper portion 188 is an attachment lug 191 provided to rotatably support wash arm 172 above stationary hub 170.

As outlined above, a portion of the washing fluid that is directed into wash arm 172 is diverted into filter chamber 143 through sampling port 153. Soil particles too large to pass through filtering screen 160 are trapped within filter chamber 143 and, ultimately, collect into a fine particle collection chamber 215 (FIGS. 6 and 7). Fine particle collection chamber 215 is provided with an opening 218 that leads into drain passage 69. Opening 218 is provided with a valve 225 that, during select portions of a washing operation, opens to allow the soil particles collected within fine particle collection chamber 215 to pass into drain passage 69. Preferably, valve 225 is constituted by an electrically activated solenoid-type valve that, upon activation, causes a plunger 227 to be drawn into a valve body 228, thus allowing passage through opening 218. Actually, in accordance with the most preferred form of the present invention, drain passage 69 constitutes a bifurcated drain passage having a coarse particle portion 236 and a fine particle portion 237. Thus, as best shown in FIGS. 6 and 7, large soil particles flowing into intake ring 35 travel with the washing fluid and ultimately collect within coarse particle collection chamber 38. The coarse particles are withdrawn from dishwasher 2 during various drain/purge operations performed by drain pump 111. In addition, fine soil particles collecting within fine particle collection chamber 215 are withdrawn from filter chamber 143 during the various drain/purge operations concurrently with coarse soil particles from coarse soil particle collection chamber 38. Alternatively, in the event that filter screen 160 becomes clogged, valve 225 can open, as shown in FIG. 7, allowing the passage of soil into fine particle conduit 237 in order to prevent an excessive pressure build-up within fine soil filter chamber 143. With this particular arrangement, a multi-size particle collection system can be incorporated into dishwasher 2 without allowing fine soil particles and coarse soil particles to intermix prior to draining.

In further accordance with the most preferred embodiment of the present invention, valve 225 includes an anti-clog element 240 that projects, substantially perpendicularly, from a top portion (not separately labeled) of plunger 227. Anti-clog element 240 is adapted to prevent the formation of a soil dome across opening 218. That is, as soil begins to accumulate within fine particle collection chamber 215, a portion of that soil can collect and form a dome across opening 218. The dome of soil may cause a clog, preventing fluid from readily draining through opening 218 when valve 225 is open. In order to prevent the formation of a soil dome, anti-clog element 240 projects through opening 218 and serves to prevent soil build-up in this region, thereby avoiding the formation of any clog. In accordance with one aspect of the this embodiment, anti-clog element 240 is constituted by a generally umbrella-shaped, resilient cover 241, having an upward projecting post 242 secured to plunger 227. As best seen in FIG. 6, post 242 extends through opening 218 into fine particle collection chamber 215 to prevent the accumulation of soil which could lead to clogs. On the other hand, umbrella-shaped cover 241 forms an air dome which traps a volume of air within an interior portion (not separately labeled) of plunger 227 that prevents water or debris from entering into and degrading the operation of valve 225.

With particular reference to FIG. 4, filter assembly 140 includes a flow plate 246 over which passes fluid leading from washing tub 28 and filter chamber 143 back into intake ring 35 to be recirculated with the washing fluid. Flow plate 246 includes an annular plateau 247 that leads to a downwardly projecting lip 248 which extends into intake ring 35. In addition, interposed between coarse particle strainer 36 and flow plate 246 is an annular filter ring 249 that prevents large objects from entering into, and possibly clogging, intake ring 35. Annular filter ring 249 rests within a notch 250 defined by an inner perimeter of coarse particle strainer 36. Annular filter ring 249 extends through an angled portion 251 that includes a plurality of openings 252 and abuts annular plateau 247. In still further accordance with the present invention, filter assembly 140 includes a bleed valve 260 (FIGS. 6 and 7) that enables air trapped within lower portions of sump 33 during an initial fill portion of the washing operation to pass up into washing tub 28. More specifically, as washing fluid enters washing tub 28, sump 33 and fluid conduits 67-69, air may become trapped within various regions of filter assembly 140 and sump 33. Thus, during an initial operation of wash pump 110 to recirculate washing fluid in washing tub 28, air may be ingested into wash pump 110 causing cavitation or hesitation of wash pump 110. In order to prevent this particular problem, as washing fluid is being introduced into washing tub 28, air being displaced by the washing fluid is allowed to pass upward through bleed valve 260 and escape into washing tub 28 so as to purge any trapped air from within filter assembly 140 and sump 33. In this manner, the overall performance of dishwasher 2 can be enhanced with particular focus being upon noise reduction and increasing pump life.

In any event, the particular construction and arrangement of filter assembly 140 contributes to forming a washing tub 28 with minimal vertical height, without sacrificing washing operation performance. In other words, sump 33 and filter assembly 140 of the present invention enables the construction of drawer-type dishwasher 2 that includes many of the advantageous features of larger dishwashers, such as multi-stage filtering, wash fluid flow management, food choppers and the like, without increasing an overall vertical height of dishwasher 2. In addition, the construction of sump 33 simplifies the overall assembling process for dishwasher 2. Furthermore, washing tub 28 can be provided with a turbidity sensor 300 (FIG. 3) to control advantageous washing operations, particularly unscheduled drain and purging operations.

Although described with reference to a preferred embodiment of the present invention, it should be readily apparent to one of ordinary skill in the art that various changes and/or modifications can be made to the invention without departing from the spirit thereof. For instance, while described as a dual drawer-type dishwasher system, the present invention can be incorporated into single drawer dishwashers, as well as combination drawer and conventional tub models. Furthermore, it should be understood that the various advantageous features of the present invention, including multi-stage filtering and stationary hub soil collection, can be incorporated individually into the dishwasher without departing from the sprit of the present invention. In general, the invention is only intended to be limited to the scope of the following claims.

We claim:

1. A dishwasher comprising:

a drawer including front, rear, bottom and opposing side walls that collectively define a washing tub;

a dish rack provided in the washing tub for supporting dishware during a washing operation;

a sump provided along the bottom wall of the tub, said sump including distinct inlet, recirculation and drain passages;

a strainer member arranged in the bottom wall of the washing tub above the sump, said strainer member including a plurality of radially spaced coarse strainer openings;

a wash pump interconnected to both the inlet passage and the recirculation passage, said wash pump establishing a flow of washing fluid in the washing tub;

a drain pump in fluid communication with the sump, said drain pump being selectively activated to withdraw washing fluid from the washing tub during select portions of the washing operation;

a coarse particle collection chamber in fluid communication with the drain pump;

a filter assembly arranged above the sump and radially inward of the strainer member, said filter assembly being divided into a filter chamber and a washing fluid manifold, said washing fluid manifold having an inlet for receiving the flow of washing fluid from the inlet passage, an outlet that directs the flow of washing fluid upward into the washing tub and a sampling port that diverts a portion of the washing fluid into the filter chamber, said filter assembly including a cover member mounted above the filter chamber and washing fluid manifold, said cover member including at least one enlarged opening, arranged above the filter chamber and provided with a fine mesh filtering screen for entrapping soil from the washing fluid in the filter chamber while permitting cleansed washing fluid to be directed back into the washing tub, and an opening exposed to the washing fluid manifold;

a fine particle collection chamber formed integral with the filter chamber, said fine particle collection chamber including an outlet portion, that leads to the drain pump;

a valve arranged at the outlet portion of the fine particle collection chamber, said valve being selectively opened to allow soil particles to flow from the filter chamber, through the fine particle collection chamber and to the drain pump;

a wash arm positioned above the filter assembly; said wash arm receiving the flow of washing fluid from the washing fluid manifold to spray onto dishware supported on the dish rack;

a bleed valve arranged on the cover member, said bleed valve allowing air to be expelled when the washing tub is being filled with washing fluid; and a stationary hub member positioned in the opening of the cover member for rotatably supporting the wash arm, said stationary hub member including a central passage, a sealing surface and a central shaft, wherein washing fluid flowing into the washing fluid manifold through the hub member into the wash arm forces the sealing surface against the cover member to form a tight seal.

2. A dishwasher comprising:

a drawer including front, rear, bottom and opposing side walls that collectively define a washing tub;

a dish rack provided in the washing tub for supporting dishware during a washing operation;

a sump provided along the bottom wall of the tub, said sump including distinct inlet, recirculation and drain passages;

a strainer member arranged in the bottom wall of the washing tub above the sump, said strainer member including a plurality of radially spaced coarse strainer openings;

a wash pump interconnected to both the inlet passage and the recirculation passage, said wash pump establishing a flow of washing fluid in the washing tub;

a drain pump in fluid communication with the sump, said drain pump being selectively activated to withdraw washing fluid from the washing tub during select portions of the washing operation;

a coarse particle collection chamber in fluid communication with the drain pump;

a filter assembly arranged above the sump and radially inward of the strainer member, said filter assembly being divided into a filter chamber and a washing fluid manifold, said washing fluid manifold having an inlet for receiving the flow of washing fluid from the inlet passage, an outlet that directs the flow of washing fluid upward into the washing tub and a sampling port that diverts a portion of the washing fluid into the filter chamber;

a fine particle collection chamber formed integral with the filter chamber, said fine particle collection chamber including an outlet portion that leads to a drain passage in communication with the drain pump; and a valve arranged at the outlet portion of the fine particle collection chamber, said valve being selectively opened to allow soil particles to flow from the filter chamber, through the fine particle collection chamber and to the drain pump.

3. The dishwasher according to claim 2, wherein the valve is an electrically actuated solenoid-type valve.

4. The dishwasher according to claim 3, wherein the valve includes a plunger and a generally umbrella-shaped cover formed from a resilient material arranged on the plunger.

5. The dishwasher according to claim 4, wherein the valve further includes a post that extends from the cover, said post being adapted to project through the outlet portion of the fine particle collection chamber.

6. The dishwasher according to claim 2, wherein the drain passage is constituted by a bifurcated drain passage having a coarse particle portion exposed to the washing tub and a fine particle portion fluidly connected to the fine particle collection chamber.

7. The dishwasher according to claim 6, wherein the coarse particle portion and fine particle portion are isolated from one another to prevent fine soil particles from being carried back into the washing tub.

8. The dishwasher according to claim 6, wherein the valve is opened to allow passage of washing fluid and fine particles into the fine particle portion of the bifurcated drain passage.

9. The dishwasher according to claim 6, further comprising: a coarse particle collection chamber arranged within the coarse particle portion of the bifurcated drain passage.

10. The dishwasher according to claim 6, further comprising: a chopper assembly drivingly connected to the drain pump, said chopper assembly being adapted to macerate both fine and coarse soil particles entrained in the washing fluid.

11. A dishwasher comprising:

a drawer including front, rear, bottom and opposing side walls that collectively define a washing tub;

a dish rack provided in the washing tub for supporting dishware during a washing operation;

a sump provided along the bottom wall of the tub, said sump including distinct inlet, recirculation and drain passages;

a strainer member arranged in the bottom wall of the washing tub above the sump, said strainer member including a plurality of radially spaced coarse strainer openings;

a wash pump interconnected to both the inlet passage and the recirculation passage, said wash pump establishing a flow of washing fluid in the washing tub;

a drain pump in fluid communication with the sump, said drain pump being selectively activated to withdraw washing fluid from the washing tub during select portions of the washing operation;

a filter assembly arranged above the sump and radially inward of the strainer member, said filter assembly being divided into a filter chamber and a washing fluid manifold, said washing fluid manifold having an inlet for receiving the flow of washing fluid from the inlet passage, an outlet that directs the flow of washing fluid upward into the washing tub and a sampling port that diverts a portion of the washing fluid into the filter chamber; and a wash arm positioned above the filter assembly, said wash arm receiving the flow of washing fluid from the washing fluid manifold to spray onto dishware supported on the dish rack.

12. The dishwasher according to claim 11, wherein the filter assembly includes a cover member mounted above the filter chamber and the washing fluid manifold.

13. The dishwasher according to claim 12, wherein the cover member includes at least one opening, arranged directly above the filter chamber, provided with a mesh filtering screen.

14. The dishwasher according to claim 13, wherein the filter chamber is constituted by a fine particle filter chamber, with the mesh filtering screen having a fine mesh.

15. The dishwasher according to claim 13, wherein the cover member includes an air opening spaced from the mesh filtering screen.

16. The dishwasher according to claim 15, wherein the wash arm includes a plurality of upwardly projecting openings each having an upstanding flange portion adapted to snap-fittingly receive a jet cap.

17. The dishwasher according to claim 16, wherein the wash arm includes a plurality of downwardly projecting openings adapted to clean the mesh filtering screen.

18. The dishwasher according to claim 11, further comprising: a central, generally U-shaped intake ring arranged within the sump, said filter assembly being positioned centrally within the U-shaped intake ring.

19. The dishwasher according to claim 16, further comprising: a coarse particle collection chamber positioned in the U-shaped intake ring; said coarse particle collection chamber extending into the drain passage.

20. A dishwasher comprising:

a drawer including front, rear, bottom and opposing side walls that collectively define a washing tub;

a dish rack provided in the washing tub for supporting dishware during a washing operation;

a sump provided along the bottom wall of the tub, said sump including distinct inlet, recirculation and drain passages;

a strainer member arranged in the bottom wall of the washing tub above the sump, said strainer member including a plurality of radially spaced coarse strainer openings;

a wash pump interconnected to both the inlet passage and the recirculation passage, said wash pump establishing a flow of washing fluid in the washing tub;

a drain pump in fluid communication with the sump, said drain pump being selectively activated to withdraw washing fluid from the washing tub during select portions of the washing operation;

a filter assembly arranged above the sump and radially inward of the strainer member, said filter assembly being divided into a filter chamber and a washing fluid manifold, said washing fluid manifold having an inlet for receiving the flow of washing fluid from the inlet passage, an outlet that directs the flow of washing fluid upward into the washing tub and a sampling port that diverts a portion of the washing fluid into the filter chamber, said filter assembly including a cover member mounted above the filter chamber and washing fluid manifold, said covet member including at least one enlarged opening, arranged above the filter chamber and provided with a fine mesh filtering screen for entrapping soil from the washing fluid in the filter chamber while permitting cleansed washing fluid to be directed back into the washing tub, and an opening exposed to the washing fluid manifold; and a stationary hub member positioned in the opening of the cover member for rotatably supporting the wash arm, said hub member including a central passage, a sealing surface and a central shaft, wherein washing fluid flowing into the washing fluid manifold through the hub member into the wash arm forces the sealing surface against the cover member to form a tight seal.

21. The dishwasher according to claim 20, wherein the stationary hub member includes an upper portion including an outlet exposed to the wash arm.

22. The dishwasher according to claim 21, wherein the central shaft is adapted to abut a bottom portion of the washing fluid manifold causing the upper portion to project above the cover member.

23. The dishwasher according to claim 20, wherein the cover member includes an annular lip that defines a recessed flange, said hub member nesting within the recessed flange.

24. A dishwasher comprising:

a drawer including front, rear, bottom and opposing side walls that collectively define a washing tub;

a dish rack provided in the washing tub for supporting dishware during a washing operation;

a sump provided along the bottom wall of the tub, said sump including distinct inlet, recirculation and drain passages;

a strainer member arranged in the bottom wall of the washing tub above the sump, said strainer member including a plurality of radially spaced coarse strainer openings;

a wash pump interconnected to both the inlet passage and the recirculation passage, said wash pump establishing a flow of washing fluid in the washing tub;

a drain pump in fluid communication with the sump, said drain pump being selectively activated to withdraw washing fluid from the washing tub during select portions of the washing operation;

a filter assembly arranged above the sump and radially inward of the strainer member, said filter assembly being divided into a filter chamber and a washing fluid manifold, said washing fluid manifold having an inlet for receiving, the flow of washing fluid from the inlet passage, an outlet that directs the flow of washing fluid upward into the washing tub and a sampling port that diverts a portion of the washing fluid into the filter chamber, said filter assembly including a cover member mounted above the filter chamber and washing fluid manifold, said cover member including at least one enlarged opening, arranged above the filter chamber and provided with a fine mesh filtering screen for entrapping soil from the washing fluid in the filter chamber while permitting cleansed washing fluid to be directed back into the washing tub; and a bleed valve arranged on the cover member, said bleed valve allowing air to be expelled when the washing tub is being filled with washing fluid.

* * * * *

UNITED STATES PATENT AND TRADEMARK OFFICE

CERTIFICATE OF CORRECTION

PATENT NO. : 7,610,923 B2
APPLICATION NO. : 11/052862
DATED : November 3, 2009
INVENTOR(S) : Hedstrom et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1070 days.

Signed and Sealed this

Twelfth Day of October, 2010

David J. Kappos

David J. Kappos
*Director of the United States Patent and Trademark Office*